US012723798B2

(12) United States Patent
Venne et al.

(10) Patent No.: US 12,723,798 B2
(45) Date of Patent: Sep. 1, 2026

(54) COOLING SYSTEM FOR A VARIABLE FREQUENCY DRIVE IN A TRANSPORT REFRIGERATION UNIT

(71) Applicant: Carrier Corporation, Palm Beach Gardens, FL (US)

(72) Inventors: Samuel Venne, Brewerton, NY (US); Larry Jedik, Weedsport, NY (US); Chad Kosakowski, Pennelville, NY (US); Parmesh Verma, Manlius, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 390 days.

(21) Appl. No.: 18/466,511

(22) Filed: Sep. 13, 2023

(65) Prior Publication Data

US 2024/0093930 A1 Mar. 21, 2024

Related U.S. Application Data

(60) Provisional application No. 63/375,940, filed on Sep. 16, 2022.

(51) Int. Cl.
*F25D 17/08* (2006.01)
*F25D 11/00* (2006.01)

(52) U.S. Cl.
CPC ..... *F25D 17/08* (2013.01); *F25D 11/003* (2013.01)

(58) Field of Classification Search
CPC .... B60H 1/3227; B60H 1/323; B60H 1/3232; B60H 1/3407–3421; B60P 3/20;
(Continued)

(56) References Cited

U.S. PATENT DOCUMENTS 3,792,595 A 2/1974 Willis
4,182,134 A 1/1980 Viegas et al.
(Continued)

FOREIGN PATENT DOCUMENTS

CN 105658455 A 6/2016
CN 111130001 A * 5/2020 ..... H02B 13/02
(Continued)

OTHER PUBLICATIONS

CN-111130001-A English Translation (Year: 2020).*
(Continued)

*Primary Examiner* — Amir A Jalali
(74) *Attorney, Agent, or Firm* — Souad Hakim

(57) ABSTRACT

A cooling system for a variable frequency drive (VFD) of a transport refrigeration unit (TRU) is disclosed. The system comprises a conduit disposed within the vehicle and extending between a opening provided at a first predefined position on the outer body of the vehicle and the VFD being positioned at a second predefined position within the vehicle. The opening facilitates the inflow of ambient air within the conduit that carries the ambient air towards the VFD to enable cooling of the VFD. The system includes a grill cover adapted to be removably attached to the opening and/or the first end of the conduit, which allows entry of the ambient air within the conduit and restricts entry of outside objects and/or living organisms within the conduit.

19 Claims, 6 Drawing Sheets

(58) Field of Classification Search
CPC ..... B62D 63/08; F25D 11/003; F25D 17/08; F25B 31/006; F25B 31/92; F25B 39/028; F25B 49/025; F24F 13/20; H05K 7/20145; H05K 7/20181; H02B 1/28; H02B 1/56; H01M 50/249
See application file for complete search history.

(56) References Cited

U.S. PATENT DOCUMENTS

| | | | | |
|---|---|---|---|---|
| 4,257,240 | A | 3/1981 | Christiansen et al. | |
| 4,748,824 | A | 6/1988 | Wakabayashi et al. | |
| 5,438,842 | A | 8/1995 | Watkins et al. | |
| 6,902,473 | B1 | 6/2005 | Goobeck | |
| 9,426,903 | B1 * | 8/2016 | Morales | H05K 7/20145 |
| 9,429,151 | B2 | 8/2016 | Taras et al. | |
| 10,212,861 | B2 * | 2/2019 | Ashbaugh | H05K 7/20918 |
| 10,295,257 | B2 | 5/2019 | Fragnito et al. | |
| 10,314,200 | B2 | 6/2019 | Sykora et al. | |
| 10,502,475 | B2 | 12/2019 | Khan et al. | |
| 11,191,191 | B2 | 11/2021 | Krippner et al. | |
| 2012/0031132 | A1 * | 2/2012 | Ikemiya | B60H 1/3232 62/239 |
| 2014/0332182 | A1 | 11/2014 | Taras et al. | |
| 2016/0153678 | A1 * | 6/2016 | Papas | A62C 4/02 62/331 |
| 2017/0268814 | A1 * | 9/2017 | Sigety | F25D 23/021 |
| 2018/0257458 | A1 | 9/2018 | Gergis et al. | |
| 2018/0372347 | A1 * | 12/2018 | Carlson | F24F 13/30 |
| 2020/0333058 | A1 | 10/2020 | Takizawa et al. | |
| 2020/0340739 | A1 * | 10/2020 | Mardones Soto | F25D 17/04 |
| 2021/0138874 | A1 * | 5/2021 | Srnec | B60H 1/00428 |
| 2021/0176899 | A1 * | 6/2021 | Krippner | H05K 7/20918 |
| 2021/0333024 | A1 * | 10/2021 | Rokade | F24F 1/22 |
| 2022/0354020 | A1 * | 11/2022 | Purpus | H05K 7/20436 |
| 2024/0010049 | A1 * | 1/2024 | Saroka | F25B 47/022 |

FOREIGN PATENT DOCUMENTS

| | | | | |
|---|---|---|---|---|
| CN | 112993793 | A * | 6/2021 | B01D 53/261 |
| CN | 214665393 | U | 11/2021 | |
| EP | 2168792 | B1 | 9/2017 | |
| EP | 3180574 | B1 | 10/2019 | |
| EP | 3415844 | B1 | 8/2020 | |
| EP | 3695997 | A1 | 8/2020 | |
| EP | 3695998 | A1 | 8/2020 | |
| GB | 2343161 | A | 5/2000 | |
| JP | 7019368 | B2 | 2/2022 | |
| WO | 2009028190 | A1 | 3/2009 | |

OTHER PUBLICATIONS

CN-112993793-A English Translation (Year: 2021).*
Extended European Search Report received for EP Application No. 23197804.0, mailed on Feb. 22, 2024, 8 Pages.

* cited by examiner

COOLING SYSTEM FOR A VARIABLE FREQUENCY DRIVE IN A TRANSPORT REFRIGERATION UNIT

CROSS-REFERENCE TO RELATED APPLICATION

This patent application claims the benefit of priority of U.S. Provisional Patent Application No. 63/375,940, filed on Sep. 16, 2022, which is incorporated by reference herein in its entirety.

TECHNICAL FIELD

This invention relates to the field of transport refrigeration units, and more particularly, a cooling system for a variable frequency drive used in a transport refrigeration unit.

BACKGROUND

A variable frequency drive (VFD) may be implemented in a transport refrigeration unit (TRU) such as trailer refrigeration unit, container refrigeration unit, and truck refrigeration unit, however, the internal air-cooling system of the TRU may be insufficient in high ambient conditions and the VFD may get heated, especially by diesel genset (engine) adding heat in the cabinet of the TRU. This may cause the temperature of the VFD to increase beyond a safe limit, thereby reducing the performance or completely shutting off the VFD, which is highly undesirable. There is, therefore, a need to provide an improved cooling system for the VFD in transport refrigeration units.

SUMMARY

Described herein is a cooling system for a variable frequency drive (VFD) of a vehicle, the system comprising: a conduit disposed within the vehicle and extending between an opening provided at a first predefined position on an outer body of the vehicle and the VFD being positioned at a second predefined position within the vehicle, wherein, the opening facilitates inflow of ambient air within the conduit, and the conduit directs the ambient air towards the VFD to enable cooling of the VFD.

In one or more embodiments, the conduit comprises a first end connected to the opening and a second end disposed of in proximity to the VFD, wherein at least a section of the conduit between the first end and the second end is flexible.

In one or more embodiments, a predefined length of the conduit at the first end is elevated by a predefined angle from a longitudinal axis of the opening to restrict entry of water towards the second end of the conduit and allow automated discharge of water from the conduit through the opening.

In one or more embodiments, the first end of the conduit is secured at the opening by a clamp provided on an interior side of the opening.

In one or more embodiments, the system comprises a grill cover adapted to be removably coupled to the opening and/or the first end of the conduit, wherein a first end of the grill cover is adapted to be attached to the outer body of the vehicle and a second end of the grill cover is adapted to be attached to the first end of the conduit.

In one or more embodiments, the first end of the grill cover comprises a mesh having a plurality of pores, wherein the pores have a predefined profile and a predefined pore size that enables the mesh to allow entry of the ambient air within the conduit and restrict entry of outside objects and/or living organisms within the conduit.

In one or more embodiments, the second end of the grill cover comprises a collar of a predefined length protruding from a surface of the mesh, wherein the collar is adapted to be attached and locked with the first end of the conduit upon attaching the grill cover on the opening.

In one or more embodiments, the first end or the mesh of the grill cover has a profile corresponding to a profile of the opening and the collar of the grill cover has a profile corresponding to a profile of the first end of the conduit.

In one or more embodiments, the grill cover is adapted to be snap-fitted to the outer body of the vehicle.

In one or more embodiments, the first end of the grill cover comprises one or more engaging elements adapted to engage and lock with the outer body of the vehicle.

In one or more embodiments, the grill cover is an integral part of the outer body of the vehicle.

In one or more embodiments, the grill cover is made of a material used for the outer body of the vehicle.

In one or more embodiments, the system comprises an air filter disposed within the conduit and/or attached to the grill cover to clean the ambient air entering the conduit. the conduit is made of a material selected from one or more of a plastic, polymer, fiber, and steel.

In one or more embodiments, the system comprises a flap movably configured at the first end of the conduit or the opening, the flap is adapted to move between a closed position and an open position, and wherein, when the vehicle moves and/or an external fan associated with the VFD turns ON, the airflow automatically moves the flap to the open position, thereby opening the opening and allowing the ambient air to flow within the conduit, and when the vehicle is stationary, the flap automatically moves to the closed position and covers the opening.

In one or more embodiments, the vehicle comprises a transport refrigeration unit (TRU) coupled to a transportation cargo, wherein the VFD is operatively coupled to a compressor of a refrigeration system and/or one or more fans associated with the TRU.

In one or more embodiments, the VFD is positioned within a chassis on one side of a cabinet of the TRU such that the VFD remains thermally separated from an engine of the TRU, and wherein the opening is provided at the outer body of the cabinet on the VFD side.

In one or more embodiments, the opening is provided at an outer surface of a door of the cabinet, and the VFD is positioned within a chassis of the cabinet on the door side such that the VFD remains thermally separated from an engine of the TRU.

In one or more embodiments, the opening is provided at the outer body at front of the cabinet and the VFD is positioned within the cabinet such that the VFD remains in thermally separated an engine of the TRU.

In one or more embodiments, the conduit extends between an inlet or an air grill associated with a condenser of the TRU, and the VFD is positioned at the second predefined position within the cabinet, wherein the conduit is configured to direct the flow of air from the condenser to the VFD for cooling the VFD. The flow of air to cool VFD can come from inlet to the condenser or from outlet to the condenser.

The foregoing summary is illustrative only and is not intended to be in any way limiting. In addition to the illustrative aspects, embodiments, and features described above, further aspects, embodiments, features, and techniques of the invention will become more apparent from the following description taken in conjunction with the drawings.

BRIEF DESCRIPTION OF THE DRAWINGS

The accompanying drawings are included to provide a further understanding of the subject disclosure of this invention and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

In the specification, reference may be made to the spatial relationships between various components and to the spatial orientation of various aspects of components as the devices are depicted in the attached drawings. However, as will be recognized by those skilled in the art after a complete reading of the subject disclosure, the components of this invention. described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, as the conduit, opening, VFD, grill cover, and corresponding components, described herein may be oriented in any desired direction.

Figure 1A:
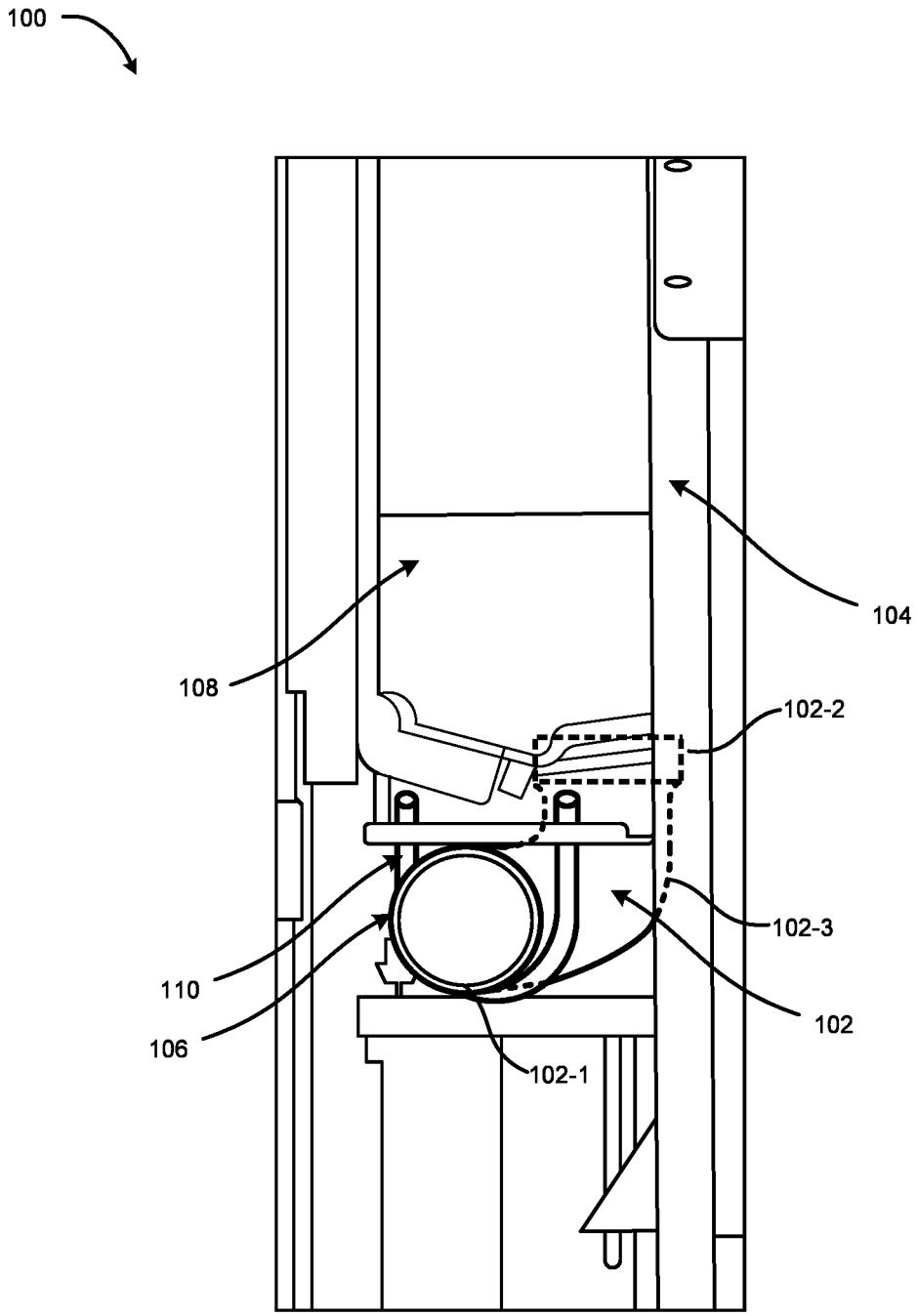
FIG. 1A illustrates an exemplary internal view of the cooling system for VFD of a transport refrigeration unit (TRU), without the outer body/panel or grill cover over the TRU in accordance with one or more embodiments of the disclosure.
Figure 1B:
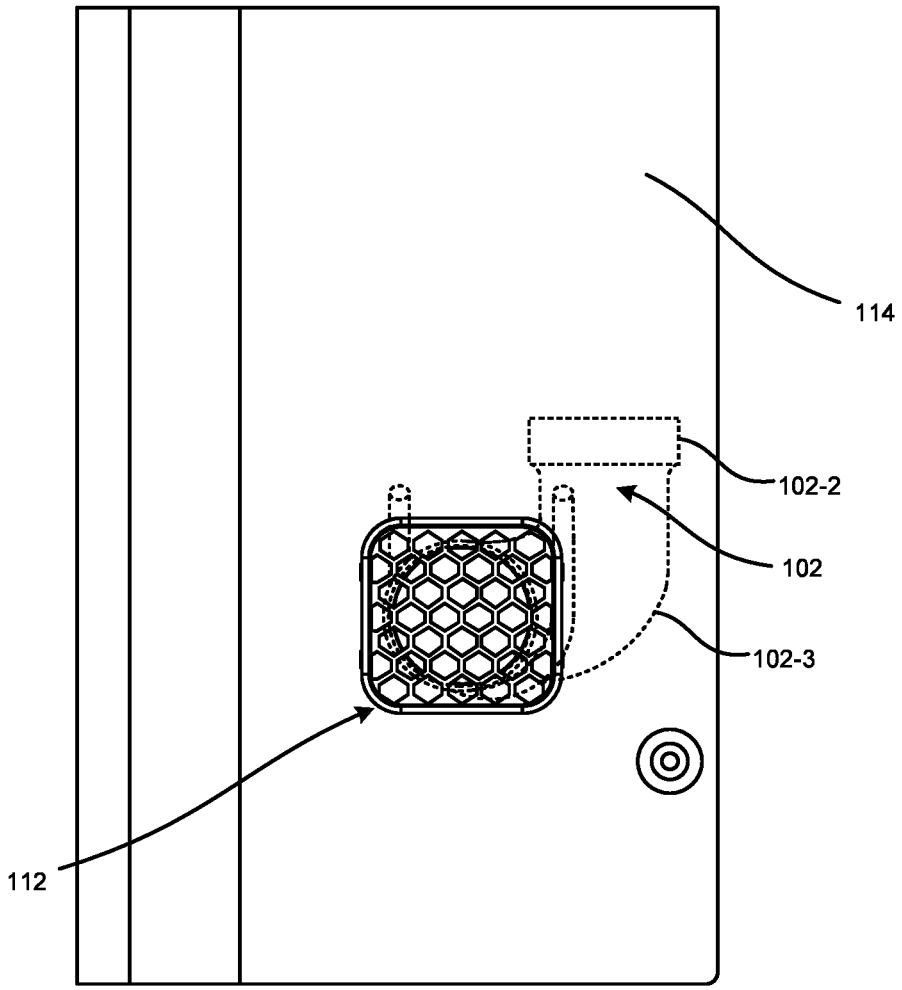
FIG. 1B illustrates an exemplary view of the cooling system of FIG. 1A, wherein a grill cover is attached over the opening, and the outer body of the TRU in accordance with one or more embodiments of the disclosure.
Figure 1C:
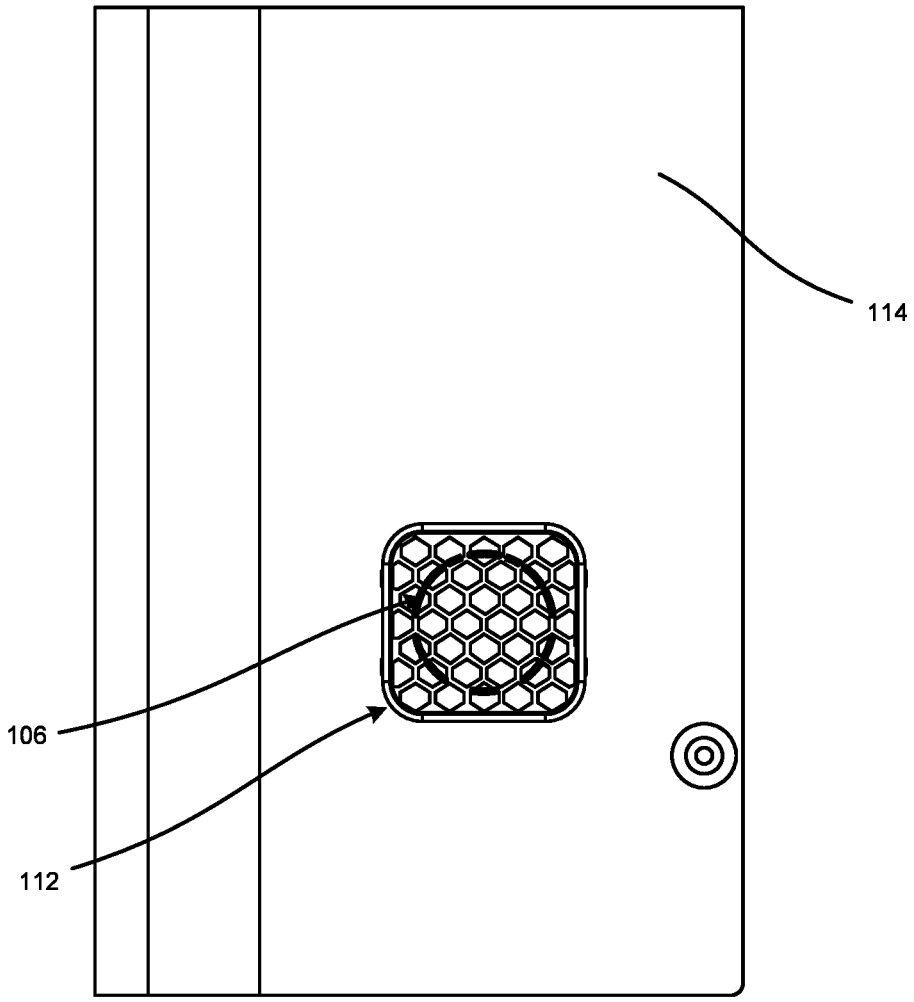
FIG. 1C illustrates an exemplary view depicting the outer body of FIG. 1B having the grill cover attached over the opening provided on the outer body of the TRU in accordance with one or more embodiments of the disclosure
Figure 2C:
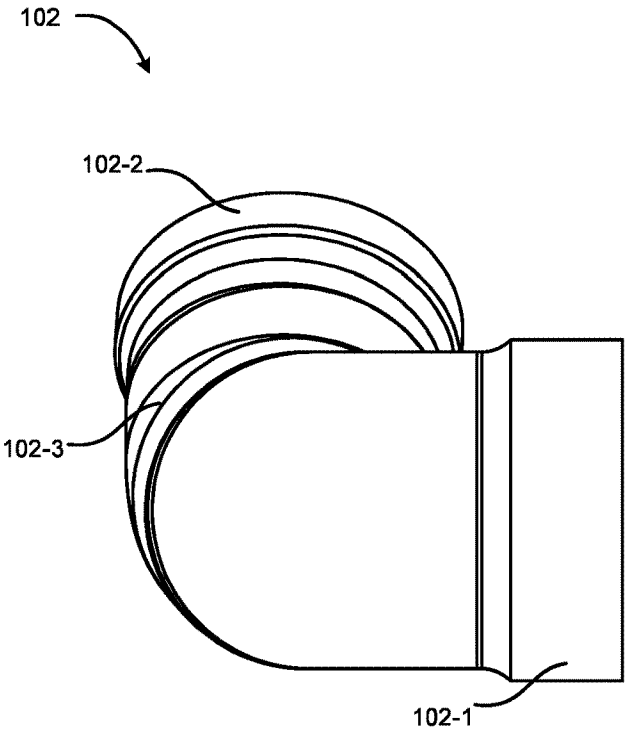
FIGS. 2A to 2C illustrate exemplary views of the conduit used in the cooling system of the TRU in accordance with one or more embodiments of the disclosure.
Figure 2B:
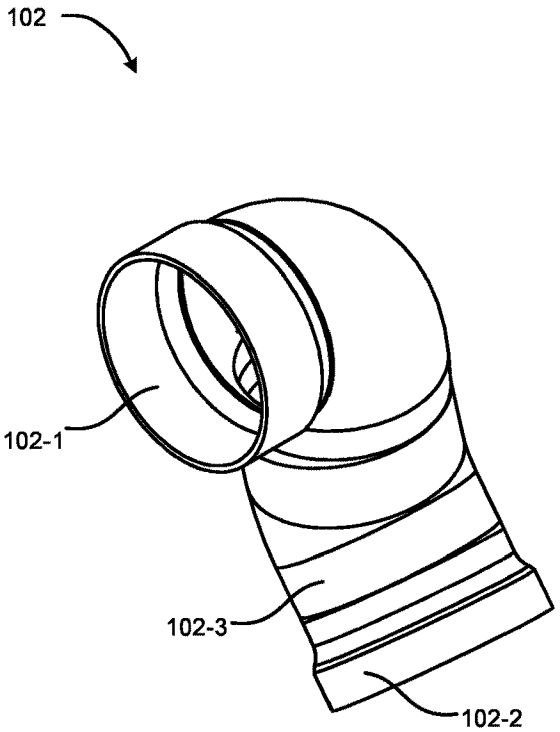
Figure 2A:
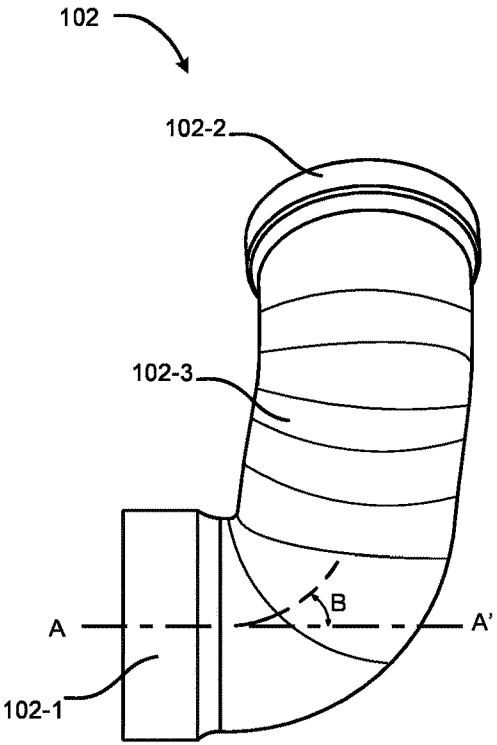
Figure 3B:
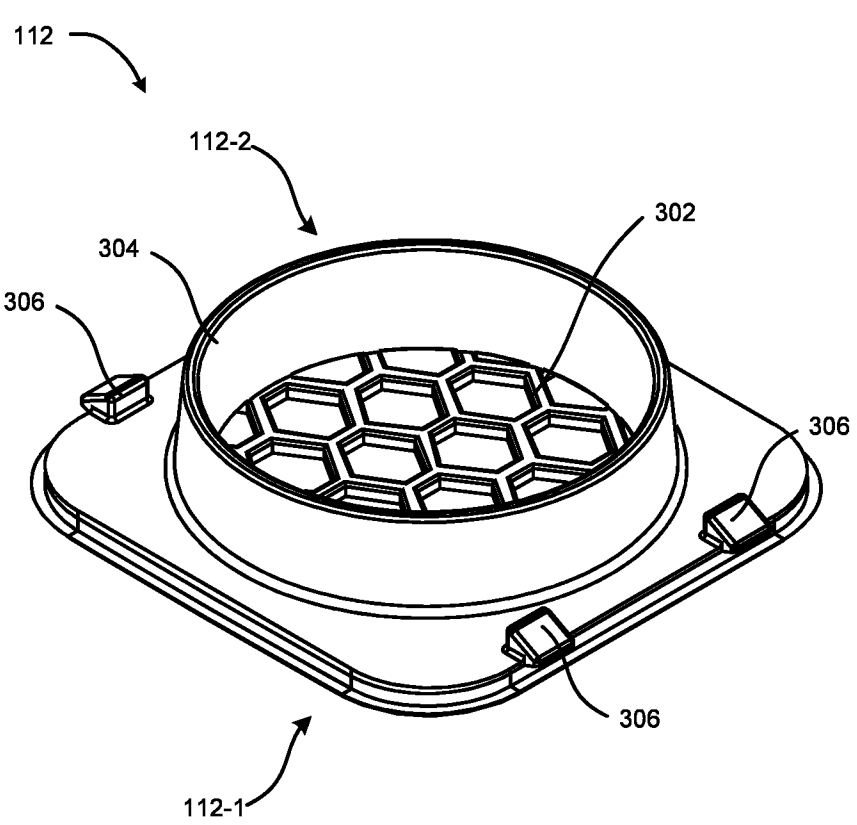
FIGS. 3A to 3E illustrate exemplary views of the grill cover of the cooling system of the TRU in accordance with one or more embodiments of the disclosure.
Figure 3A:
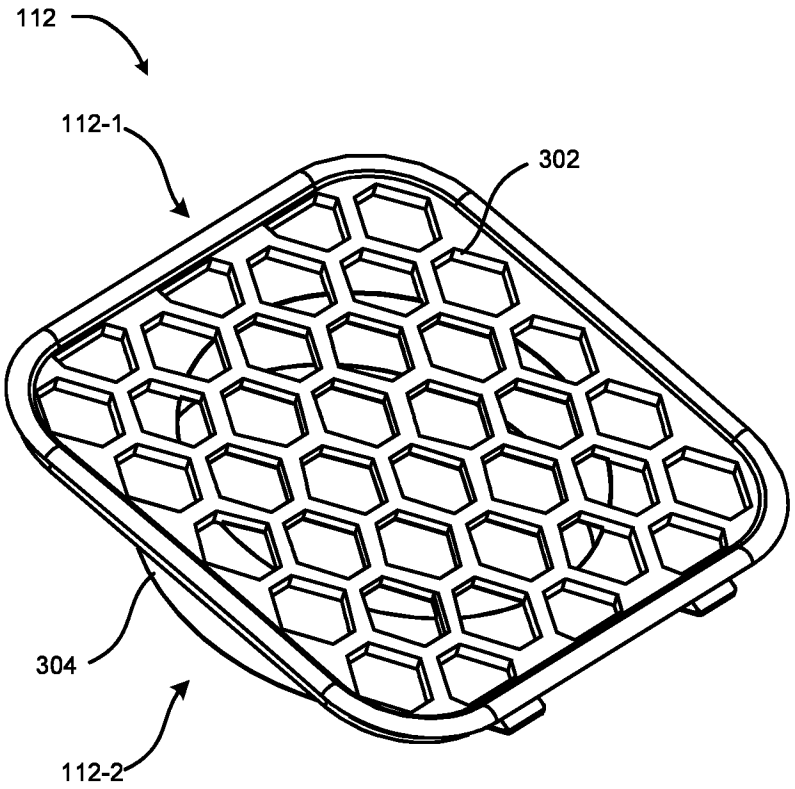
Figure 3E:
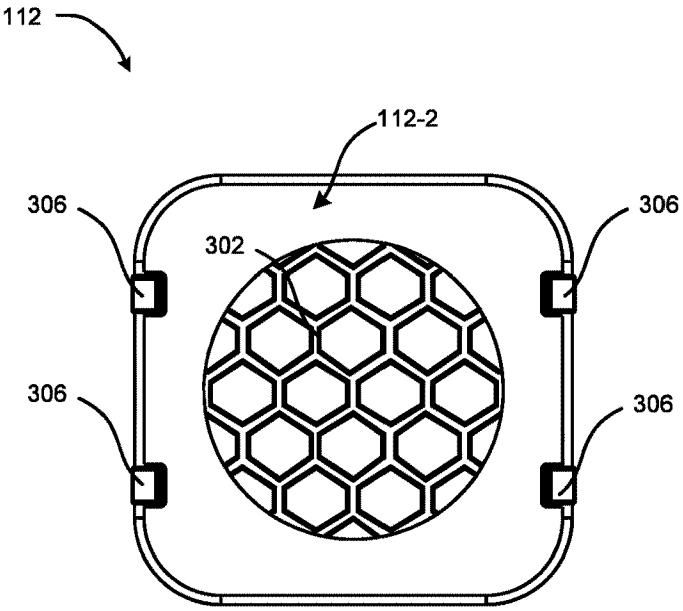
Figure 3D:
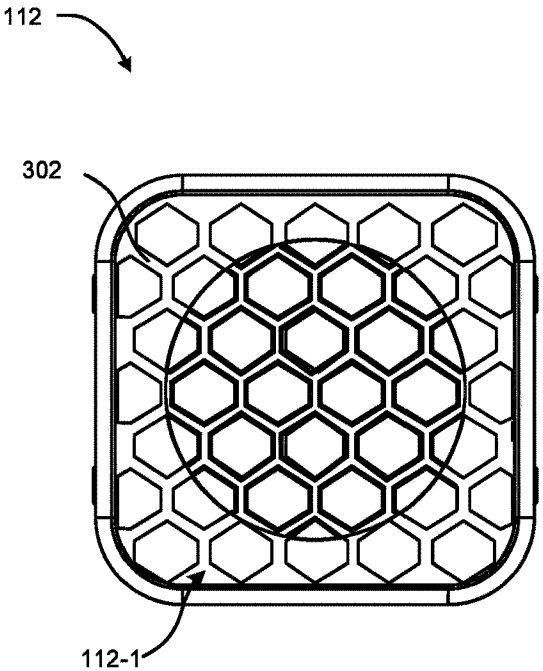
Figure 3C:
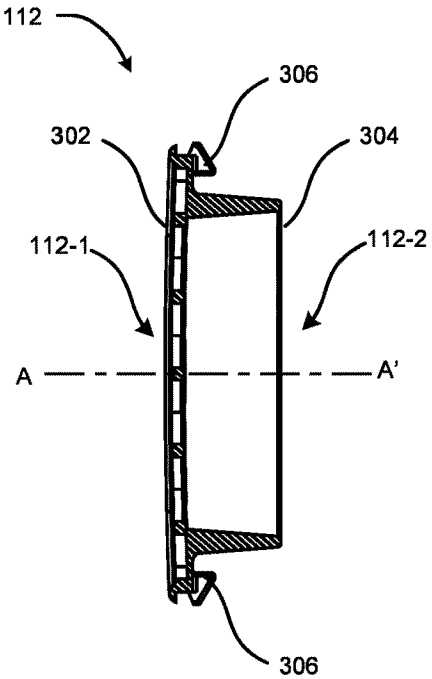

Referring to FIG. 1A to 1C, an exemplary embodiment of the cooling system 100 for a variable frequency drive (VFD 108) and internal components of a transport refrigeration unit (TRU) or a vehicle is disclosed. The transport refrigeration unit includes a trailer refrigeration unit, a container refrigeration unit, a truck refrigeration unit, and the like. The TRU includes a cabinet being configured with a transportation cargo and the VFD 108 is associated with a compressor of a refrigeration system and/or one or fans associated with the TRU. The system 100 includes a conduit 102 as shown in FIGS. 2A to 2C being disposed within a chassis 104 of the cabinet of the TRU, such that the conduit 102 extends between a opening 106 provided at a first predefined position on the outer body 114 of the TRU and the VFD 108 being positioned internally within the body 104 of the TRU. A first end 102-1 of the conduit 102 is adapted to be connected to the opening 106 and a second end 102-2 of the conduit 102 is disposed in proximity to the VFD 108. The second end 102-2 may be at an inlet side of the fan associated with the internal cooling system of the VFD 108. In other embodiments, an external fan can be provided on the door or first end of the conduit 102, thereby eliminating the requirement of an internal fan or internal cooling system for the VFD 108. The external fan at the door or duct serves the same purpose of cooling VFD with colder ambient air, by enabling the inflow of colder ambient air within the conduit 102 and directing the colder ambient air to the VFD to facilitate cooling of the VFD 108. Further, in one or more embodiments, a section 102-3 of the conduit 102 between the first end 102-1 and the second end 102-1, or the complete conduit 102 may be flexible, which allows easier positioning of the conduit 102 within the chassis 104 of the TRU. Thus, the opening 106 provided on the outer body 114 of the TRU facilitates the inflow of ambient air within the conduit 102 that carries the ambient air towards the VFD 108, thereby providing fresher lower ambient temperature air to the VFD 108 to maintain the VFD 108 at a safe operable temperature. In addition, the VFD 108 can be positioned at a second predefined position within the TRU such that the VFD 108 remains close to ambient and/or at a safe distance from an engine of the TRU such that the VFD remains thermally separated from the heat generated by the engine so as to minimize the transfer of heat from the engine to the VFD, thereby enabling quick and efficient cooling of the VFD 108.

In some embodiments, the VFD 108 is positioned within the chassis on one side of the cabinet of the TRU, however, at a safe distance from the engine such that the VFD remains thermally separated from the engine to minimize the transfer of heat from the engine to the VFD. Further, the opening 106 is provided at the outer body 114 of the cabinet on the side where the VFD 108 is disposed. In other embodiments, the opening 106 is provided at the outer surface of the door 114 of the cabinet, and the VFD 108 is positioned within chassis 104 of the cabinet on the door side of the TRU such that the VFD 108 remains thermally separated from the heat generated by the engine. In another embodiment, the opening 106 is provided at the outer body 114 in front of the cabinet, and the VFD 108 is positioned within the cabinet, however, the VFD 108 must be disposed away or at a safe distance from the engine of the TRU to reduce the effect of heat generated by the engine on the TRU. In addition, the conduit 102 may also extend between an air grill (not shown) or an inlet associated with a condenser of the TRU and the VFD 108 may be positioned within the cabinet of the TRU. This allows the conduit 102 or system 100 to directly receive ambient air from the air grill of the condenser and/or from the condenser. Thus, the cooling system or conduit 102 allows either the flow of ambient air from outside or cool air from the condenser inlet towards the VFD 108 to maintain the VFD 108 at a desired temperature. Similarly, the VFD 108 can also be positioned at other positions within the TRU, however, at a safe distance from the engine of the TRU, to minimize any effect from the heat of the engine on the VFD 108. In one or more embodiments, the system 100 includes a clamp 110, preferably having a U-shaped profile as shown in FIGS. 1A and 1B, being positioned at the interior side of the opening 106 to hold the first end 102-1 of the conduit 102 at the opening 106. However, the clamp of other designs or profiles may also be implemented in the cooling system 100. The clamp 110 facilitates easier opening of the door as required to allow serviceability or maintenance of the VFD 108 or conduit 102. In addition, clamp 110 also allows easier fitting or alignment of the grill cover 112 on the duct or conduit 102. Further, the rest of portions 102-2, 102-3 of the conduit 102 can extend within the chassis 104 of the TRU through a duct (not shown) extending between the opening 106 and the VFD 108.

The system 100 includes a grill cover 112 as illustrated in FIGS. 3A to 3E, that is adapted to be removably coupled to the opening 106 and/or the first end 102-1 of the conduit 102. A first end 112-1 of the grill cover 112 is adapted to be attached to the outer body 114 of the TRU and a second end 112-2 of the grill cover 112 is adapted to be attached to the first end of the conduit 102. The first end 112-1 of the grill cover 112 may have a profile corresponding to a profile of the opening 106 and the second end 112-2 of the grill cover 112 may have a profile corresponding to a profile of the first end 102-1 of the conduit 102, which enables attachment of the second end 112-2 of the grill cover 112 to the first end 102-1 of the conduit 102 upon attaching the grill cover 112 on the outer body 114 or opening 106 of the TRU.

The first end 112-1 of the grill cover 112 includes a mesh 302 having a plurality of pores. The pores may have a predefined profile and a predefined pore size that enables the mesh 302 to allow entry of the ambient air within the conduit 102 and restrict the entry of outside objects and/or living organisms within the conduit 102. For example, the pores of the grill cover 112 can have a honeycomb profile, circular profile, or polygonal profile, but are not limited to the like. Further, the second end 112-2 of the grill cover 112 includes a collar 304 of a predefined length protruding from the surface of the mesh 302. The collar 304 can be a cylindrical protrusion of a predetermined diameter and length, such that the collar 304 gets attached and locked with the first end 102-1 of the conduit 102 upon attaching the grill cover 112 to the opening 106. In one or more embodiments (now shown), the grill cover 112 may be a louvered vent cover that facilitates air flow through a fixture that incorporates slanted pieces, which also the entry of outside objects, water, and/or living organisms within the conduit 102. Similarly, a grill cover having slant edges or other vent styles may also be configured with the opening and first end of the conduit 102.

An interior side of the first end 112-1 of the grill cover 112 includes one or more engaging elements 306 (collectively referred to as engaging elements 306, herein) that are adapted to engage and lock with grooves (not shown) provided around the opening 106 on the outer body 114 of the TRU, thereby allowing easier attachment on and/or removal of the grill cover 112 from the outer body 114 of the TRU. In one embodiment, the grill cover 112 can be adapted to be snap-fitted to the outer body 114 of the TRU. In another embodiment, the grill cover 112 can be an integral part of the outer body 114 of the TRU. The grill cover 112 may preferably be made of the same material as the outer body 114 of the TRU to enhance the aesthetics of the TRU, however, the grill cover 112 may also be made of a different material. In one or more embodiments, the door is removably coupled to the chassis of the cabinet, which facilitates easier removal of the door as required to allow serviceability or maintenance of the VFD 108. In addition, this also allows easier fitting of the grill cover 112, the conduit 102, and the clamp 112 with the TRU. Further, the conduit 102 is made of a material selected from one or more of plastic, polymer, fiber, and steel, but not limited to the like.

In one or more embodiments, the system 100 includes an air filter (not shown) disposed within the conduit 102 and/or attached to the grill cover 112 to clean the ambient air entering the conduit 102, which decreases degradation of the VFD 108 or internal components of the TRU. In addition, as shown in FIG. 2A, a predefined length of the conduit 102 at the first end 102-1 is elevated by a predefined angle (B) from a longitudinal axis (A-A') of the opening 106 to restrict the entry of water towards the second end 102-2 of the conduit 102 and allow automated discharge of water from the conduit 102 through the opening 106 or first end of the conduit 102. The conduit 102 may either extend upward or downward within the body of the cabinet. Further, a flap (not shown) can be movably configured at the first end of the conduit 102 or the opening 106, such that when the vehicle moves or when the external fan at the door or inlet of conduit 102 is turned ON, the ambient air automatically may move the flap to an open position, thereby opening the opening 106 and allowing the colder ambient air to flow within the conduit 102 and cool the VFD 108. Further, when the vehicle is stationary or when the external fan is tuned OFF, the flap automatically moves back to the closed position and covers the opening 106. Thus, the system 100 restricts the entry of outside objects, water, and/or living organisms within the conduit 102, thereby preventing the VFD 108 and other internal components of the TRU from weathering and degradation.

While various embodiments of this invention have been elaborated for a conduit having a circular cross-section, and the grill cover and the opening having a specific shape, however, the conduits, grill cover, and opening can also be of other shapes, sizes, and profiles. In addition, while embodiments of this invention have been elaborated for a cooling system for the VFD of a transport refrigeration unit (TRU), however, the cooling system can also be configured with any vehicle where external or ambient cooling is required.

Thus, this invention (system) overcomes the drawbacks, limitations, and shortcomings associated with existing technologies by providing an external and efficient cooling system for the VFD in a transport refrigeration unit or a vehicle to provide fresher lower ambient temperature air to the VFD to maintain the VFD at a safe operable temperature.

While the invention has been described with reference to exemplary embodiments, it will be understood by those skilled in the art that various changes may be made and equivalents may be substituted for elements thereof without departing from the scope of the invention as defined by the appended claims. Modifications may be made to adopt a particular situation or material to the teachings of the invention without departing from the scope thereof. Therefore, it is intended that the invention not be limited to the particular embodiment disclosed, but that the invention includes all embodiments falling within the scope of the invention as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The invention claimed is:

1. A cooling system for a variable frequency drive (VFD) of a vehicle, the cooling system comprising:

a conduit disposed within the vehicle and extending between an opening provided at a first predefined position on an outer body of the vehicle and the VFD being positioned at a second predefined position within the vehicle, wherein, the opening facilitates inflow of ambient air within the conduit; and the conduit directs the ambient air towards the VFD to enable cooling of the VFD, wherein the vehicle comprises a transport refrigeration unit (TRU) coupled to a transportation cargo, and wherein the VFD is operatively coupled to a compressor of a refrigeration system and one or more fans associated with the TRU.

2. The cooling system of claim 1, wherein the conduit comprises a first end connected to the opening and a second end disposed of in proximity to the VFD, and wherein at least a section of the conduit between the first end and the second end is flexible.

3. The cooling system of claim 2, wherein the first end of the conduit and/or a grill cover is secured at the opening by a clamp provided at an interior side of the opening.

4. The cooling system of claim 3, wherein the cooling system comprises the grill cover adapted to be removably coupled to the opening and/or the first end of the conduit, wherein a first end of the grill cover is adapted to be attached to the outer body of the vehicle and a second end of the grill cover is adapted to be attached to the first end of the conduit.

5. The cooling system of claim 4, wherein the first end of the grill cover comprises a mesh having a plurality of pores, wherein the pores have a predefined profile and a predefined pore size that enables the mesh to allow entry of the ambient air within the conduit and restrict entry of outside objects and/or living organisms within the conduit.

6. The cooling system of claim 5, wherein the second end of the grill cover comprises a collar of a predefined length protruding from a surface of the mesh, wherein the collar is adapted to be attached and locked with the first end of the conduit upon attaching the grill cover on the opening.

7. The cooling system of claim 5, wherein the first end or the mesh of the grill cover has a profile corresponding to a profile of the opening and the collar of the grill cover has a profile corresponding to a profile of the first end of the conduit.

8. The cooling system of claim 4, wherein the grill cover is adapted to be snap-fitted to the outer body of the vehicle.

9. The cooling system of claim 4, wherein the first end of the grill cover comprises one or more engaging elements adapted to engage and lock with the outer body of the vehicle.

10. The cooling system of claim 4, wherein the grill cover is an integral part of the outer body of the vehicle.

11. The cooling system of claim 4, wherein the grill cover is made of a material used for the outer body of the vehicle.

12. The cooling system of claim 4, wherein the cooling system comprises an air filter disposed within the conduit and/or in the VFD and/or attached to the grill cover to clean the ambient air entering the conduit.

13. The cooling system of claim 2, wherein the cooling system comprises a flap movably configured at the first end of the conduit or the opening, the flap is adapted to move between a close position and an open position, and wherein, when the vehicle moves and/or an external fan associated with the VFD turns ON, the airflow automatically moves the flap to the open position, thereby opening the opening and allowing the ambient air to flow within the conduit, and when the vehicle is stationary or when the VFD fan is OFF, the flap automatically moves to the closed position and covers the opening.

14. The cooling system of claim 1, wherein a predefined length of the conduit at the first end is elevated by a predefined angle from a longitudinal axis of the opening to restrict entry of water towards the second end of the conduit and allow automated discharge of water from the conduit through the opening.

15. The cooling system of claim 1, wherein the conduit is made of a material selected from one or more of plastic, polymer, rubber, fiber, and steel.

16. The cooling system of claim 1, wherein the VFD is positioned within a chassis on one side of a cabinet of the TRU such that the VFD remains thermally separated from an engine of the TRU, and wherein the opening is provided at the outer body of the cabinet on the VFD side.

17. The cooling system of claim 1, wherein the opening is provided at an outer surface of a door of the cabinet and the VFD is positioned within a chassis of the cabinet on a door side such that the VFD remains thermally separated from an engine of the TRU.

18. The cooling system of claim 1, wherein the opening is provided at the outer body at a front of a cabinet and the VFD is positioned within the cabinet such that the VFD remains thermally separated from an engine of the TRU.

19. The cooling system of claim 1, wherein the conduit extends between an inlet or an air grill associated with a condenser of the TRU and the VFD is positioned at the second predefined position within the cabinet, wherein the conduit is configured to direct the flow of air from inlet or outlet of the condenser to the VFD for cooling the VFD.

* * * * *